United States Patent [19]

Toon

[11] Patent Number: 4,519,201

[45] Date of Patent: May 28, 1985

[54] PROCESS FOR BLENDING FIBERS AND TEXTILES OBTAINED FROM THE FIBER BLENDS

[76] Inventor: John J. Toon, 2200 Piedmont Rd. NE., Marietta, Ga. 30062

[21] Appl. No.: 415,937

[22] Filed: Sep. 8, 1982

[51] Int. Cl.[3] ..... D02G 3/12; D02G 3/04; D01G 13/00

[52] U.S. Cl. ..... 57/252; 57/255; 57/327; 57/901

[58] Field of Search ..... 57/252, 255, 901, 327; 139/425

[56] References Cited

U.S. PATENT DOCUMENTS

| | | | |
|---|---|---|---|
| 2,991,538 | 7/1961 | Hendley | 57/252 X |
| 3,007,227 | 11/1961 | Moler | 57/255 X |
| 3,288,175 | 11/1966 | Valko | 57/255 X |
| 3,422,460 | 1/1969 | Burke et al. | 57/252 X |
| 3,670,485 | 6/1972 | Brown et al. | 57/327 |
| 3,678,675 | 7/1972 | Klein | 57/252 X |
| 3,722,440 | 3/1973 | Igarashi et al. | 57/255 X |
| 3,828,543 | 8/1974 | Goodbar et al. | 57/901 X |
| 3,882,667 | 5/1975 | Barry | 57/255 X |

OTHER PUBLICATIONS

Modern Textile Magazine; Gerald F. Barry, Jun. 1967, pp. 54–56.

*Primary Examiner*—Donald Watkins
*Attorney, Agent, or Firm*—Cushman, Darby & Cushman

[57] ABSTRACT

The present invention relates to an improved process for blending together textile like fibers exhibiting a relatively high modulus of elasticity together with textile fibers exhibiting a relatively low modulus of elasticity which blend can further be converted into a high quality blended yarn structure. When the textile fibers exhibiting the relatively high modulus of elasticity are also electrically conductive, such as e.g. metal or carbon fibers, then the resulting yarns and fabrics can be designed with a predetermined level of electrical conductivity.

8 Claims, 1 Drawing Figure

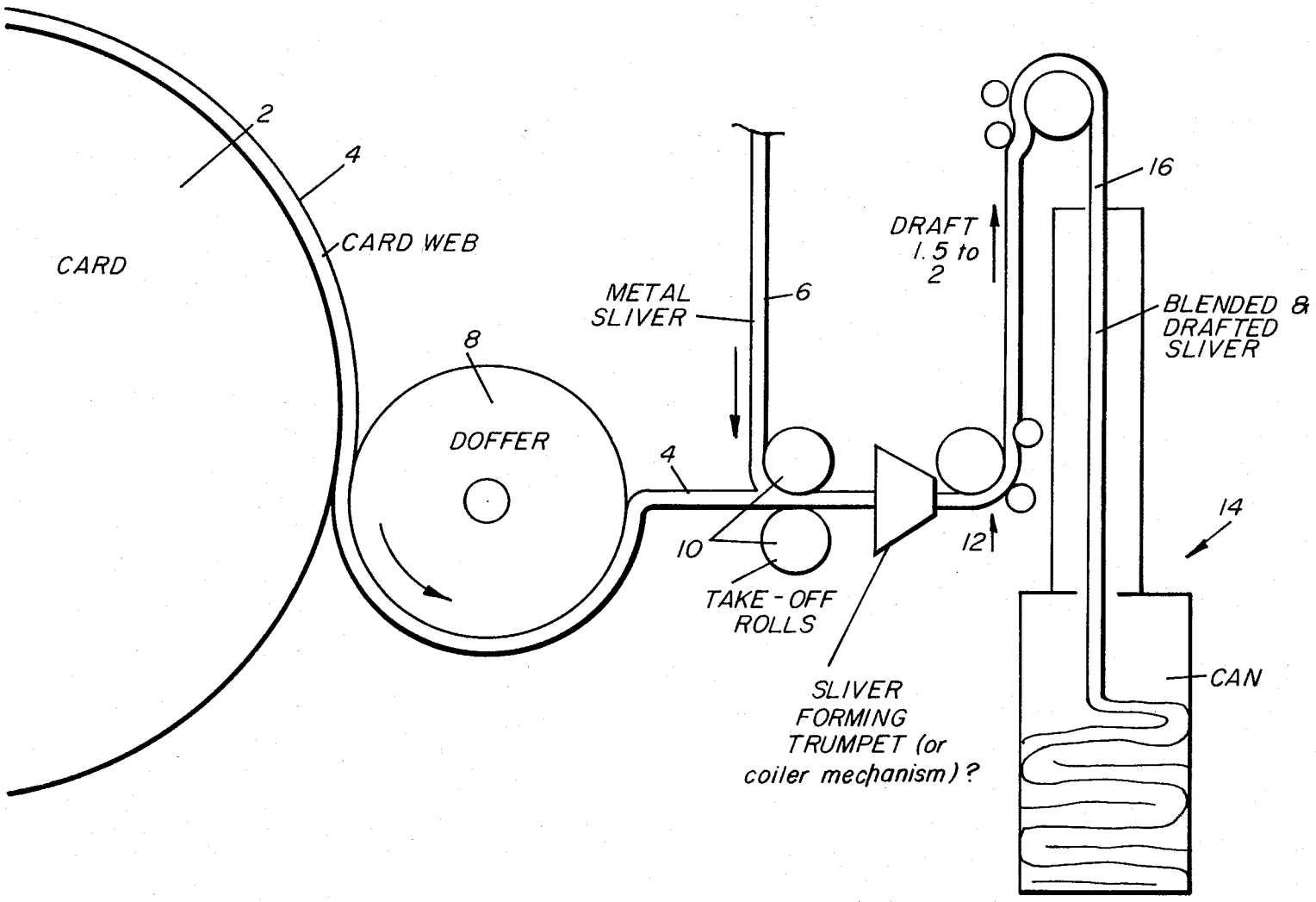
BLENDED & DRAFTED SLIVER
16
14
CAN
DRAFT 1.5 to 2
12
SLIVER FORMING TRUMPET (or coiler mechanism)?
6
TAKE-OFF ROLLS
10
METAL SLIVER
4
DOFFER
8
CARD WEB
4
2
CARD

PROCESS FOR BLENDING FIBERS AND TEXTILES OBTAINED FROM THE FIBER BLENDS

FIELD OF THE INVENTION

This invention relates to the blend of both high and low modulus of elasticity fibers with a sufficient amount of the high modulus fibers being electrically conductive to provide a predetermined electrical conductivity in the blended yarn or textile product with blending occurring in a manner that allows a smaller percentage of the high modulus fibers to be more homogeneously blended in the final resulting product.

BACKGROUND OF THE PRESENT INVENTION

In conventional fiber blending and yarn manufacturing procedures, the fibers are generally submitted to tensioning forces by which they are broken up to a certain extent. As long as the fibers to be blended have approximately the same stress-strain characteristics no substantial problems arise during blending or in obtaining the desired and controllable break-up and homogeneity of the blend.

However, on blending fibers with substantially different elasticity modulus, during which process all the fibers are normally subjected to approximately the same tension forces or tensile stresses, the fibers with a low elasticity modulus will tend to elongate substantially more than the fibers with a high elasticity modulus.

At the end of each blending step, when the tension on the composite fiber bundle is removed, the fibers with a low modulus will consequently tend to retract more than the fibers with a high modulus, and as both kinds of fibers are in frictional engagement with each other, the fibers with high modulus will be subjected to certain axial compression type forces. Accordingly, these fibers will be forced to curl more or less about the retracting fibers, which remain relatively straight. This curling effect must substantially be avoided, as it tends to decrease the degree of homogeneity of the blend in an uncontrollable way. Moreover, we must take into account, that this curling effect will be enhanced proportionally to the volume percentage of the low modulus fibers present in the blend. Consequently, control of the homogeneity of the resulting blend can become more critical as the percentage of the high modulus fibers in the blend is reduced. When the high modulus fibers additionally have a greater stiffness or a greater bending modulus than the low modulus fibers, which is often the case, it will be difficult and even quite impossible to pick or unravel the entangled mass or clustered slubs of high modulus fibers within the bundle, during further blending steps. In fact, contrary to what is desired, further blending on pin drafters, for example, can enhance the curling, entangling and clustering of the high modulus fibers to form knots within the sliver or fiber bundle, rather than unraveling the slubs.

Further, when choosing the diameters of the low and high modulus fibers so that they have about the same breaking load, there will of course be a tendency for the high modulus fibers to break up much more in short pieces than the neighboring low modulus fibers. Attempts have already been made to control the break-up of the high modulus fibers, but most such attempts have failed more or less. In U.S. Pat. No. 3,670,485 there is a proposal to deliver metal filament bundles (high modulus fibers) to partially carded textile fiber webs and further carding this combination to break the metal filaments into short fibers and blend them substantially uniformly with the textile fibers. However, the break-up of the high modulus fibers is generally too drastic and a substantial amount of these fibers are torn almost to dust and lost from the card web before this web is condensed and wound up.

In another instance, high modulus metal fiber slivers or tows were sandwiched between textile slivers at the input of a draw frame with the aim being to cushion the high modulus fibers between the adjacent low modulus fibers and so to counteract severe crushing and uncontrollable rupture of the high modulus fibers. This is suggested in "Modern Textiles Magazine"—June 1967, page 54, top of third column. However, this method requres that multiple consecutive drawing and blending steps are required either to come to a desirable low blending percentage of high modulus fibers or to effect a sufficient breakdown of the high modulus fibers or both. This is due to the fact that the bundle of high modulus fibers to be introduced should be of sufficient size to be handled and moved without rupture in view of the average fiber length in it. Hence the actual blending method on the draw frame, although generally useful in obtaining a desired blend, is quite unproductive, certainly in those instances where a very low percentage of high modulus fibers in the blend is desirable.

BRIEF DESCRIPTION OF THE DRAWING

FIGURE 1 is a side elevational view of an apparatus to blend fibers according to the process of the present invention.

DESCRIPTION OF THE PRESENT INVENTION

According to the present invention, as shown in FIG. 1, the disadvantages of the known blending methods are overcome by combining a bundle or sliver of the high modulus fibers 6 with a sliver of the low modulus fibers 4 at a point where this last sliver is condensed at the exit of a card 2. This preferably occurs directly at the output end of the carding operation and most desirably downstream of the doffer 8 and between the take-off rolls 10 of the card and the coiler mechanism therefore, generally indicated at 12. The high modulus or metal sliver is laid directly on the sliver of low modulus fibers and will together pass through the coiler mechanism and be coiled together. The composite sliver is then slightly drafted between the take-off rolls and the coiler head with a draft ratio of less than about 2 (200 percent) and then collected as indicated at 14. During this drafting, since an initial blending will have already been achieved, the high modulus fibers are not, however, broken up. The resulting composite sliver 16 can then be further combined in a conventional manner with textile slivers and drafted on draw frames and ultimately spun into blended yarns. A good blending uniformity of the high modulus fibers in the blend is obtained as well as a substantially uniform length distribution of those same high modulus fibers, which length can vary between about 2 mm and about 30 mm. This result is achievable with fewer processing steps than had previously been required, especially for blended yarns including a very low percentage of the high modulus fibers. Thus, a yarn can be formed so as to be comprised of a blend of high modulus of elasticity fibers and low modulus of elasticity fibers with the fiber length distribution of the high modulus fibers in the blend being substantially uniform within that yarn.

It should be understood that throughout this specification, the term "relatively high modulus" means a modulus of elasticity of at least $7\times10^4$ Newtons per square mm ($N/mm^2$).

The invention is particularly useful for the design of textiles with a controllable electrical conductivity: yarns, woven fabrics, knitted fabrics, knotted and various types of non-woven or felted fabrics with the high modulus fibers therein having a certain electrical conductivity and comprised of materials such as metal or carbon fibers, metallized glass fibers, etc. The low modulus fibers are textile synthetic and/or natural fibers or blends thereof could also be employed. Specifically, this includes, without limitation, Nomex, nylon, wool, cotton, Kevlar or blends.

The resulting textiles can be rendered antistatic with a conductive fiber content of less than about 2%, by weight, and even less than about 0.5% by weight. At a higher percentage such as 3% to 25%, the fabrics can be used as radar reflectors or in conductive suits such as for live-line working or as heater fabrics through electrical resistance heating.

Due to a more even length distribution of the high modulus fibers between a fiber length of about 2 mm and about 30 mm than up to now had been achievable, woven fabrics with about 0.5% to about 2% by weight stainless steel fibers in both warp and weft yarns, depending upon yarn size, yarn construction and fabric construction, are suitable for radar camouflage fabrics thereby providing a degree of camouflaging over a broad range of radar frequencies. For radar camouflage purposes, the electrically conductive fibers are preferably metal fibers with a specific conductivity of less than about 10% of the Cu-standard. Stainless steel fibers have a conductivity of about 2% of the Cu-standard and offer appropriate reflection and absorption capacity of micro-wave energy, such as from radar waves, impinging thereon.

EXAMPLE

A 2,000 Tex sliver stainless steel fibers with a diameter of 6.5 nm and a breaking length (as set in the breaker) of 60 mm (as sold under the trademark BEKINOX) was introduced into a 60 grain polyester textile sliver at the calendar rolls of a Hollingsworth card where the card web is condensed into a sliver. The combined sliver was drafted with a draft ratio of 150%. The BEKINOX fibers were not broken down by this draft process. The drafted sliver was collected in the usual manner. In a further step this preblended sliver was blended with six other 60 grain polyester textile slivers at the finisher draw frame (Ideal draw frame). During the draw frame operation, increased efficiency was observed due to fewer production interruptions. After conventional spinning, the ultimate yarn contained about 15% by weight of BEKINOX-fibers.

Although the method described was a typical cotton yarn spinning system, the invention would also apply to other yarn spinning systems.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures.

What I claim is:

1. An improved process of blending a first predetermined proportion of textile like fibers, exhibiting a relatively high modulus of elasticity, in the form of a bundle together with a second predetermined proportion of textile fibers, exhibiting a relatively low modulus of elasticity, in the form of a sliver, comprising the steps of combining said bundle of said high modulus fibers with said sliver of said low modulus fibers at a point where the sliver is formed by condensing at the exit of a card and drafting the composite sliver with a draft ratio of less than about 2 before collecting it so that a substantially uniform length distribution, ranging from about 2 mm to about 30 mm of the high modulus fiber, is achieved on the ultimate blended yarn after further conventional drafting and spinning.

2. A process according to claim 1 wherein the high modulus fibers are metal fibers.

3. A process according to claim 1 or 2 including the additional steps of combining the composite sliver with additional textile slivers, which combination is then further drafted on a draw frame and processed to a blended yarn.

4. A yarn comprised of a blend of a first group of fibers with a high modulus of elasticity and a second group of fibers with a low modulus of elasticity, the fiber length distribution of the high modulus fibers in the blend being substantially uniform and the length of the high modulus fibers ranging therein between about 2 mm and about 30 mm.

5. A yarn as in claim 4 wherein said first group of high modulus fibers are electrically conductive and the percentage thereof is less than about 2% by weight in the yarn.

6. A textile product with a predetermined electrical conductivity comprised of yarns themselves comprised of a blend of electrically conductive fibers with a high modulus of elasticity having a length varying between about 2 mm to about 30 mm and of fibers with a low modulus of elasticity, the fiber length distribution of the high modulus fibers in the blended yarn being substantially uniform, the resulting textile product having the electrically conductive fibers in the blended yarns ranging from about 0.5% to about 2.0% by weight.

7. A textile product according to claim 6 comprising a woven fabric with warp and weft yarns each having a high modulus fiber content of less than about 2% by weight.

8. A textile product according to claim 6 or 7 wherein the electrically conductive high modulus metal fibers have a specific conductivity of less than about 10% of the CU-standard.

* * * * *